US008853586B2

(12) United States Patent
Theisen et al.

(10) Patent No.: US 8,853,586 B2
(45) Date of Patent: Oct. 7, 2014

(54) ELECTRICAL SWITCHING APPARATUS INCLUDING MAGNET ASSEMBLY AND FIRST AND SECOND ARC CHAMBERS

(71) Applicant: Eaton Corporation, Cleveland, OH (US)

(72) Inventors: Peter J. Theisen, West Bend, WI (US); Paul J. Rollman, Brown Deer, WI (US); Mark A. Juds, New Berlin, WI (US); Xin Zhou, Franklin Park, PA (US)

(73) Assignee: Eaton Corporation, Cleveland, OH (US)

( * ) Notice: Subject to any disclaimer, the term of this patent is extended or adjusted under 35 U.S.C. 154(b) by 230 days.

(21) Appl. No.: 13/664,555

(22) Filed: Oct. 31, 2012

(65) Prior Publication Data

US 2013/0112655 A1 May 9, 2013

Related U.S. Application Data

(60) Provisional application No. 61/557,584, filed on Nov. 9, 2011.

(51) Int. Cl.

| | |
|---|---|
| ***H01H 9/44*** | (2006.01) |
| ***H01H 1/20*** | (2006.01) |
| ***H01H 9/46*** | (2006.01) |

(52) U.S. Cl.

CPC ..... *H01H 9/443* (2013.01); *H01H 1/2066* (2013.01); *H01H 9/46* (2013.01)

USPC ..... 218/26; 335/14; 335/78

(58) Field of Classification Search

USPC ..... 335/14, 78; 218/22–26

See application file for complete search history.

(56) References Cited

U.S. PATENT DOCUMENTS 4,820,205 A * 4/1989 Schmiedel et al. ..... 439/733.1
4,897,625 A * 1/1990 Yokoyama et al. ..... 335/14

(Continued)

FOREIGN PATENT DOCUMENTS

EP 1 548 772 A1 6/2005
GB 1 509 146 A1 4/1978

OTHER PUBLICATIONS

Siemens Industry, Inc "Heavy Duty Photovoltaic Disconnect Switches", www.usa.siemens.com/switches, 2010, 4 pp.

(Continued)

*Primary Examiner* — Truc Nguyen

(74) *Attorney, Agent, or Firm* — Eckert Seamans Cherin & Mellot, LLC; Kirk D. Houser

(57) ABSTRACT

An electrical switching apparatus includes two arc runners, two contacts in electrical communication with the respective runners, a movable contact having two portions respectively cooperating with the contacts to provide closed and open contact positions, and two arc chambers each including two ends, a longitudinal axis therebetween, and arc plates between the ends. A magnet assembly cooperates with the arc chambers to establish a generally unidirectional magnetic field normal to the axes, normal to a first direction of a first arc between one contact and the first portion as it moves away from the closed toward the open contact position, and normal to an opposite second direction of a second arc between the other contact and the second portion as it moves away from the closed toward the open contact position. The magnetic field causes one arc to enter one arc chamber depending upon current flow direction between the contacts.

21 Claims, 6 Drawing Sheets

(56) References Cited

U.S. PATENT DOCUMENTS

| | | | | |
|---|---|---|---|---|
| 5,004,874 | A | 4/1991 | Theisen et al. | |
| 5,130,504 | A | 7/1992 | Moldovan et al. | |
| 5,266,760 | A * | 11/1993 | Link et al. | 200/244 |
| 5,319,169 | A * | 6/1994 | Link et al. | 200/401 |
| 5,546,061 | A * | 8/1996 | Okabayashi et al. | 335/78 |
| 2005/0150870 | A1 | 7/2005 | Schneider et al. | |
| 2009/0127229 | A1 | 5/2009 | Schmitz et al. | |

OTHER PUBLICATIONS

Tyco Electronics, "Kilovac EV250-1A & 1B—400 Amps ("Czonka II EVX")", www.tycoelectronics.com, 2010, pp. 16 and 19.

European Patent Office, "International Search Report and Written Opinion", Feb. 14, 2013, 12 pp.

* cited by examiner

ELECTRICAL SWITCHING APPARATUS INCLUDING MAGNET ASSEMBLY AND FIRST AND SECOND ARC CHAMBERS

CROSS REFERENCE TO RELATED APPLICATION

This application claims the benefit of U.S. Provisional Patent Application Ser. No. 61/557,584, filed Nov. 9, 2011, which is incorporated by reference herein.

BACKGROUND

1. Field

The disclosed concept pertains generally to electrical switching apparatus and, more particularly, to circuit interrupters, such as circuit breakers.

2. Background Information

Electrical switching apparatus employing separable contacts exposed to air can be structured to open a power circuit carrying appreciable current. These electrical switching apparatus, such as, for instance, circuit breakers, typically experience arcing as the contacts separate and commonly incorporate arc chambers, such as arc chutes, to help extinguish the arc. Such arc chutes typically comprise a plurality of electrically conductive arc plates held in a spaced relation around the separable contacts by an electrically insulative housing. The arc transfers to the arc plates where it is stretched, split and cooled until extinguished.

Conventional miniature circuit breakers (MCBs) are not specifically designed for use in direct current (DC) applications. When conventional alternating current (AC) MCBs are sought to be applied in DC applications, multiple poles are electrically connected in series to achieve the required interruption or switching performance based upon the desired system DC voltage and system DC current.

One of the challenges in DC current interruption/switching, especially at a relatively low DC current, is to drive the arc into the arc chamber. Known DC electrical switching apparatus employ permanent magnets to drive the arc into arc splitting plates. A known problem associated with such permanent magnets in known DC electrical switching apparatus is unidirectional current flow operation of the DC electrical switching apparatus. A proposed solution to provide bi-directional current flow operation in a molded case circuit breaker (MCCB) is a double-break design (e.g., similar to the contact structure of a contactor) including two sets of contacts, and two separate arc chambers with a stack of arc plates for each arc chamber, where each arc chamber has a pair of magnets to generate opposite magnetic fields to drive an arc into a corresponding stack of arc plates depending upon the direction of the current. This problem and its proposed solution make it very difficult to implement a permanent magnet design for typical DC MCBs without a significant increase in size and cost.

There is room for improvement in electrical switching apparatus that can switch direct current.

There is also room for improvement in direct current arc chambers.

SUMMARY

These needs and others are met by embodiments of the disclosed concept in which a generally unidirectional magnetic field causes one of a first arc and a second arc to enter one of first and second arc chambers, respectively, depending upon a direction of current flow between a first contact and a second contact.

In accordance with aspects of the disclosed concept, an electrical switching apparatus comprises: a first arc runner; a second arc runner; a first contact in electrical communication with the first arc runner; a second contact in electrical communication with the second arc runner; a movable contact comprising a first portion and a second portion respectively cooperating with the first contact and the second contact to provide a closed contact position in which the movable contact electrically engages the first and second contacts, and an open contact position in which the movable contact is disengaged from the first and second contacts; a first arc chamber comprising a first end, an opposite second end, a longitudinal axis therebetween, and a plurality of first arc plates between the first end and the opposite second end, one of the first arc plates at the first end of the first arc chamber being proximate the first arc runner, another one of the first arc plates at the opposite second end of the first arc chamber being proximate the first portion of the movable contact as the movable contact moves from the closed contact position toward the open contact position; a second arc chamber comprising a first end, an opposite second end, a longitudinal axis therebetween, and a plurality of second arc plates between the first end and the opposite second end of the second arc chamber, one of the second arc plates at the first end of the second arc chamber being proximate the second arc runner, another one of the second arc plates at the opposite second end of the second arc chamber being proximate the second portion of the movable contact as the movable contact moves from the closed contact position toward the open contact position; an operating mechanism cooperating with the movable contact to move the movable contact between the closed contact position and the open contact position; and a magnet assembly cooperating with the first and second arc chambers to establish a generally unidirectional magnetic field normal to the longitudinal axes of the first and second arc chambers, normal to a first direction of a first arc between the first contact and the first portion of the movable contact as the movable contact moves away from the closed contact position toward the open contact position, and normal to an opposite second direction of a second arc between the second contact and the second portion of the movable contact as the movable contact moves away from the closed contact position toward the open contact position, in order that the generally unidirectional magnetic field causes one of the first arc and the second arc to enter one of the first and second arc chambers, respectively, depending upon a direction of current flow between the first contact and the second contact.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with a circuit breaker, although the disclosed concept is applicable to a wide range of electrical switching apparatus (e.g., without limitation, a switching device; a relay; a contactor; a disconnect switch).

Figure 1:
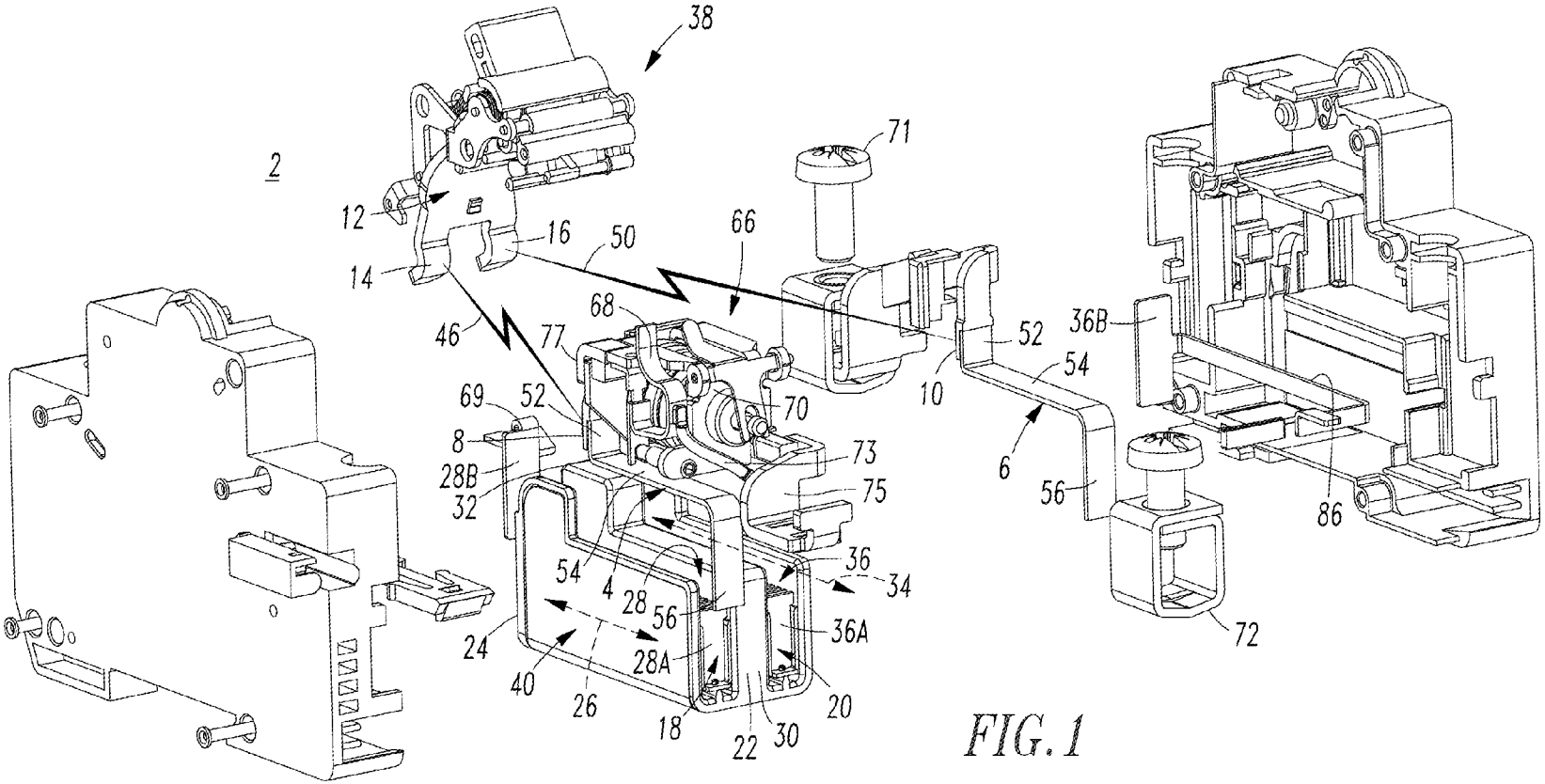
FIG. 1 is an exploded isometric view of a circuit breaker in accordance with embodiments of the disclosed concept.
Figure 2:
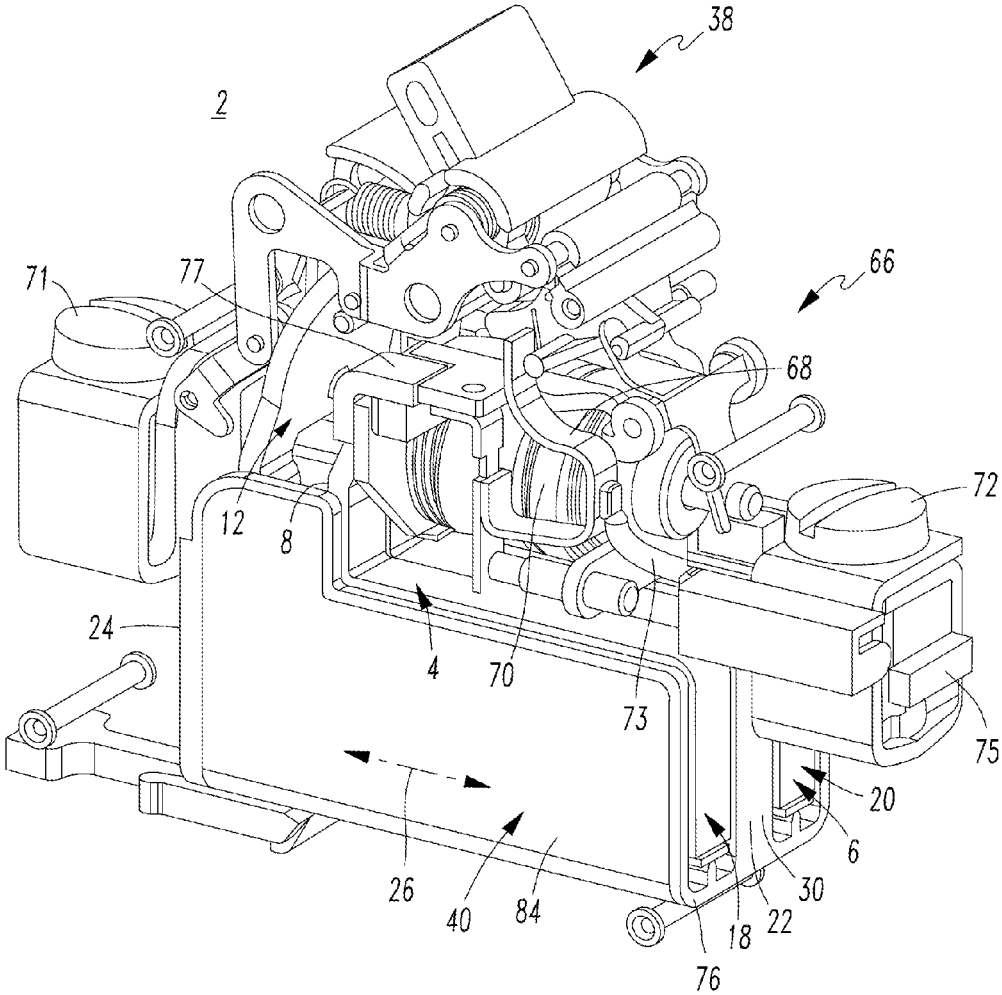
FIG. 2 is an isometric view of the circuit breaker of FIG. 1.

Referring to FIGS. 1 and 2, an electrical switching apparatus, such as the example circuit breaker 2, is shown. The circuit breaker 2 includes a first arc runner 4, a second arc runner 6, a first (fixed) contact 8 in electrical communication with the first arc runner 4, and a second (fixed) contact 10 in electrical communication with the second arc runner 6. A movable contact 12 of the circuit breaker 2 includes a first contact portion 14 and a second contact portion 16 respectively cooperating with the first contact 8 and the second contact 10 to provide a closed contact position (not shown) in which the movable contact 12 electrically engages the first and second contacts 8,10, and an open contact position in which the movable contact 12 is disengaged from the first and second contacts 8,10.

The circuit breaker 2 further includes two arc chambers 18,20. The first arc chamber 18 includes a first end 22, an opposite second end 24, a longitudinal axis 26 therebetween, and a plurality of first arc plates 28 (FIG. 3) between the first end 22 and the opposite second end 24. One 28A of the first arc plates 28 at the first end 22 of the first arc chamber 18 is proximate the first arc runner 4. Another one 28B of the first arc plates 28 at the opposite second end 24 of the first arc chamber 18 is proximate the first portion 14 of the movable contact 12 as the movable contact 12 moves from the closed contact position toward the open contact position.

The second arc chamber 20 includes a first end 30, an opposite second end 32, a longitudinal axis 34 therebetween, and a plurality of second arc plates 36 (FIG. 3) between the first end 30 and the opposite second end 32 of the second arc chamber 20. One 36A of the second arc plates 36 at the first end 30 of the second arc chamber 20 is proximate the second arc runner 6. Another one 36B of the second arc plates 36 at the opposite second end 32 of the second arc chamber 20 is proximate the second portion 16 of the movable contact 12 as the movable contact 12 moves from the closed contact position toward the open contact position.

An operating mechanism 38 cooperates with the movable contact 12 to move the movable contact 12 between the closed contact position and the open contact position.

A magnet assembly 40 (best shown in FIGS. 3 and 4) cooperates with the first and second arc chambers 18,20 to establish a generally unidirectional magnetic field 42 (FIG. 5) normal to the longitudinal axes 26,34 of the first and second arc chambers 18,20, normal to a first direction 44 (FIG. 3) of a first arc 46 between the first contact 8 and the first portion 14 of the movable contact 12 as the movable contact 12 moves away from the closed contact position toward the open contact position, and normal to an opposite second direction 48 (FIG. 3) of a second arc 50 between the second contact 10 and the second portion 16 of the movable contact 12 as the movable contact 12 moves away from the closed contact position toward the open contact position. As a result, the generally unidirectional magnetic field 42 causes one of the first arc 46 and the second arc 50 to enter one of the first and second arc chambers 18,20, respectively, depending upon the direction of current flow (e.g., interruption of direct current flowing from line terminal 71 to second contact 10 to movable contact portion 16 to movable contact portion 14 to first contact 8 through magnetic trip coil 70 to load terminal 72 causes the arcs 46,50 to flow in the two respective directions 44,48 shown in FIG. 3) between the first contact 8 and the second contact 10.

Each of the first and second arc runners 4,6 has a first portion 52 on which one of the first and second contacts 8,10, respectively, is disposed, a second portion 54 normal to the first portion 52 and extending along the longitudinal axis 26,34 of one of the first and second arc chambers 18,20, respectively, and a third portion 56 normal to the second portion 54 and extending parallel to one 28A,36A of the arc plates 28,36 at the first end 22,30 of the first and second arc chambers 18,20, respectively.

The first direction 44 (FIG. 3) of the first arc 46 between the first contact 8 and the first portion 14 of the movable contact 12 as the movable contact 12 moves away from the closed contact position toward the open contact position is generally along the longitudinal axis 26 of the first arc chamber 18 and toward the first end 22 of the first arc chamber 18. With the example direction of current flow, the generally unidirectional magnetic field 42 (FIG. 5) causes the first arc 46 to enter the first arc chamber 18. The opposite second direction 48 (FIG. 3) of the second arc 50 between the second contact 10 and the second portion 16 of the movable contact 12 as the movable contact 12 moves away from the closed contact position toward the open contact position is generally along the longitudinal axis 34 of the second arc chamber 20 and away from the first end 30 of the second arc chamber 20. Again, with the example direction of current flow, the generally unidirectional magnetic field 42 (FIG. 3) causes the second arc 50 to avoid the second arc chamber 20. Since the two fixed contacts 8,10 are disposed to one side of the circuit breaker 2, current flow operatively associated with the two arc chambers 18,20 is in opposite directions 44,48 (FIG. 3), thereby allowing use of the generally unidirectional magnetic field 42 to cause one of the two arcs 46,50 to be quenched in one of the two arc chambers 18,20 depending upon the direction of the current flow and, in particular, the direction of the current flowing in the two arcs 46,50.

Figure 3:
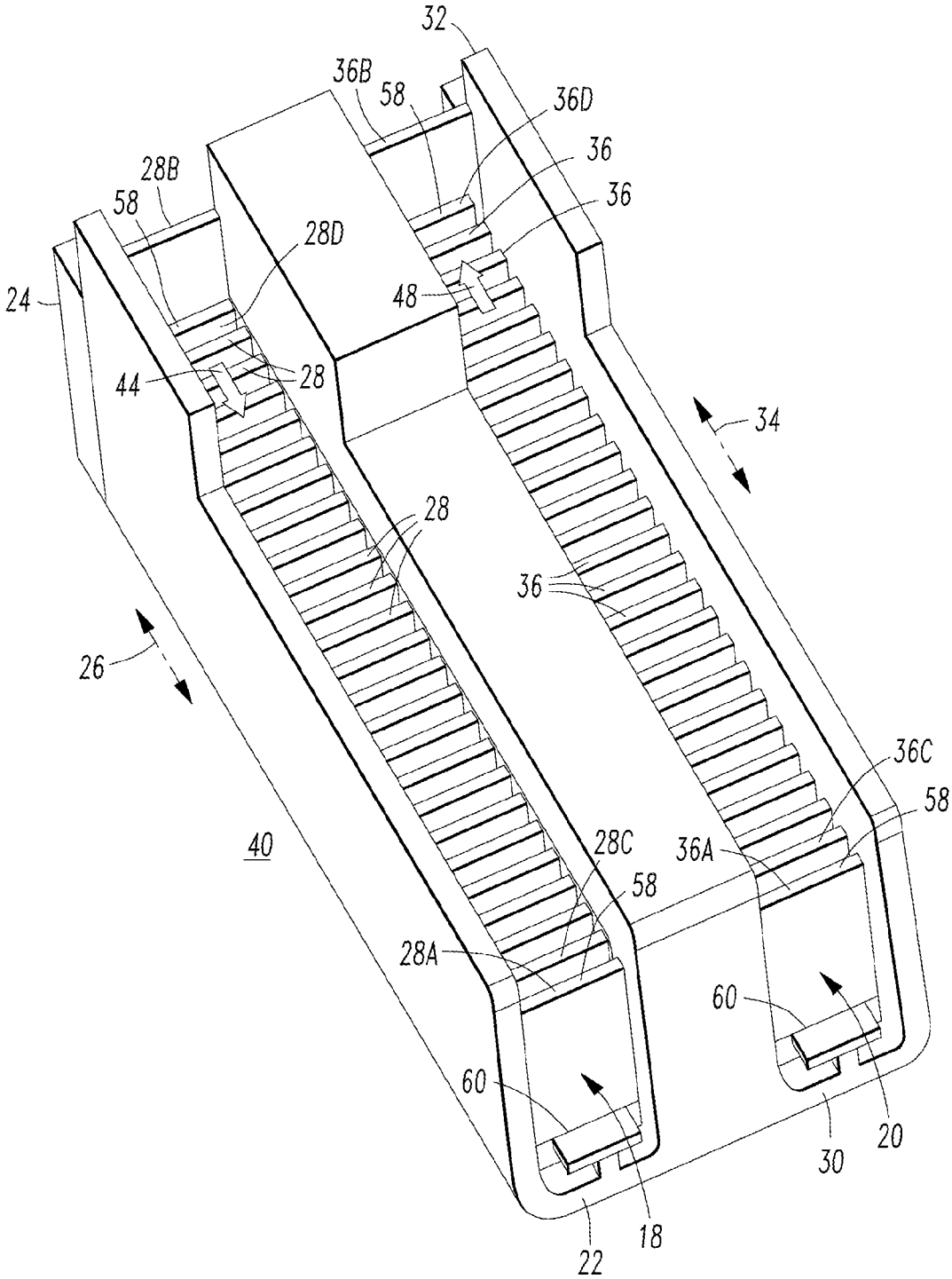
FIG. 3 is an isometric view of the dual arc chamber and magnet assembly of FIG. 1.
Figure 5:
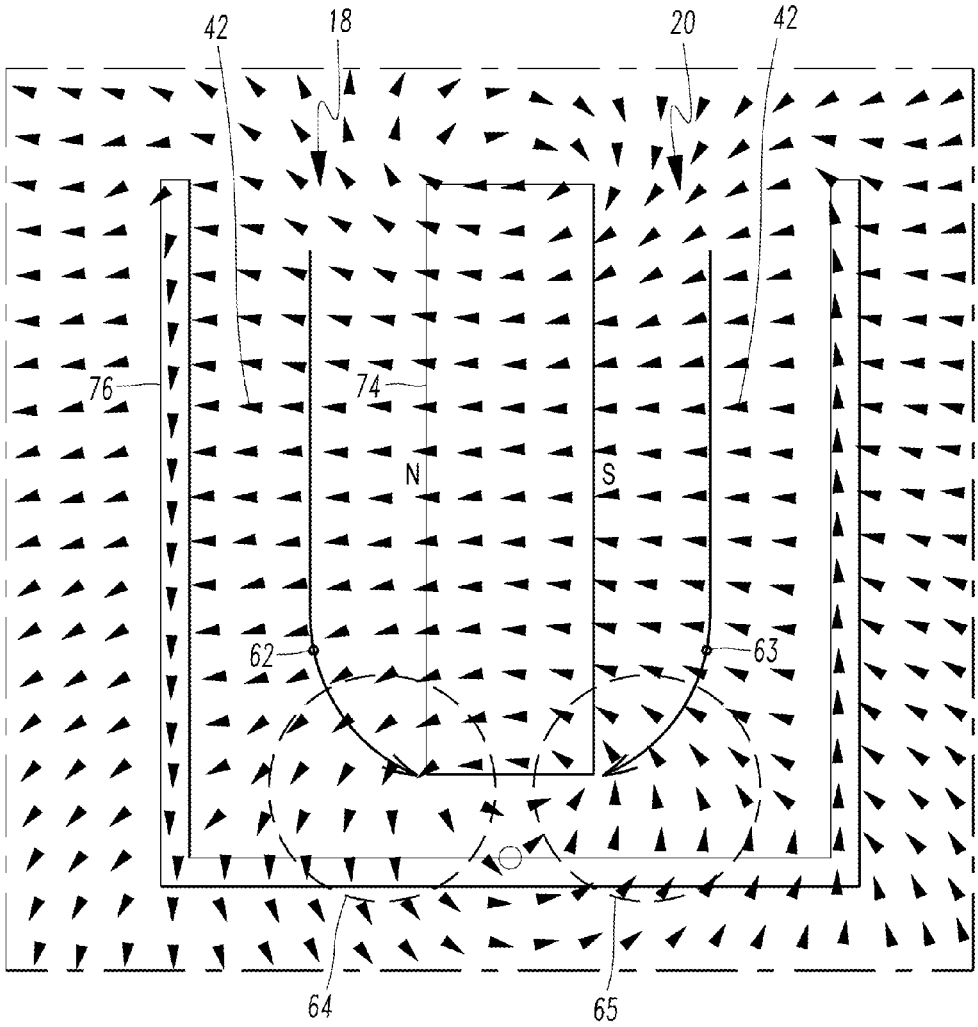
FIG. 5 is a simplified cross-sectional view of the magnet, ferromagnetic frame and generally unidirectional magnetic field of the magnet assembly of FIG. 3.

As shown in FIG. 3, the first arc plates 28 at the opposite second end 24 of the first arc chamber 18 and the second arc plates 36 at the opposite second end 32 of the second arc chamber 20 have a first end 58 facing one of the first and second portions 14,16 of the movable contact 12 and an opposite second end 60 (as shown with the arc plates 28A, 36A). The generally unidirectional magnetic field 42 (FIG. 5) is structured to cause one of the first arc 46 and the second arc 50 to define a corresponding one of two stable final arc positions 62 and 63 (FIG. 5) among the first arc plates 28 and the second arc plates 36, respectively, and toward the opposite second end 60 of the first and second arc plates 28,36. The magnetic field design (as best shown in FIG. 5) defines the stable final split arc position 62 or 63 since as the arc 46 or 50 moves progressively lower (with respect to FIGS. 1, 3 and 5) in the arc chamber 18 or 20, respectively, the generally unidirectional magnetic field 42 reverses at corresponding region 64 or 65 (FIG. 5) and causes a halt to the downward (with respect to FIGS. 1, 3 and 5) progression of the arc. This employs, for example, an "arc motion magnetic field" 42 as shown in FIG. 5.

The disclosed concept enables the direction of current flow between the first contact 8 and the second contact 10 to be selected from the group consisting of alternating current, unidirectional positive direct current, unidirectional negative direct current, and bi-directional direct current. Operation with bi-directional current is made possible since the arc 46 or 50 is directed to only one of the two arc chambers 18 or 20 depending upon the direction of the current flow and, thus, the direction of the current flow in the arc 46 or 50. This intrinsically provides bidirectional switching by the contacts 8,10, 12.

Although the disclosed electrical switching apparatus is a circuit interrupter, such as the example circuit breaker 2, it will be appreciated that the disclosed concept is applicable to any electrical switching apparatus, such as a disconnect switch. In the example embodiment, the operating mechanism 38 includes a trip mechanism 66. The example trip mechanism 66 includes at least one of a bimetal 68 and a magnetic trip coil 70. The example bimetal 68 is electrically connected to the load terminal 72 by a conductor 73. The example magnetic trip coil 70 is electrically connected between: (1) the load terminal 72 and conductor 75, and (2) the first contact 8 and a conductor 77.

Figure 4:
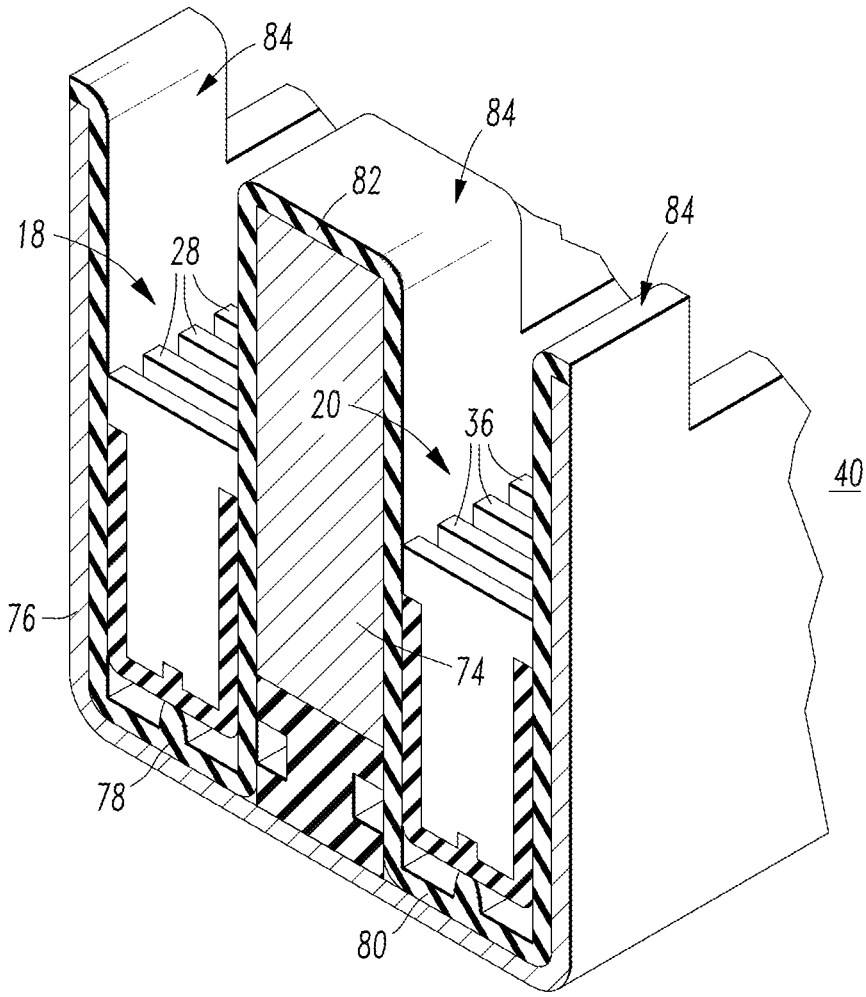
FIG. 4 is a cross-sectional view of the dual arc chamber and magnet assembly of FIG. 3.

The example magnet assembly 40 includes a permanent magnet 74 (FIGS. 4 and 5) and a ferromagnetic frame 76 (FIGS. 4 and 5). A suitable electrical insulator, such as the example plastic molded case 84, includes a first portion 78 holding the first arc chamber 18, a second portion 80 holding the second arc chamber 20, and a third portion 82 holding the permanent magnet 74 between the first and second arc chambers 18,20. The example permanent magnet 74 is a single permanent magnet, such as for example and without limitation, a single ceramic magnet (e.g., a non rare earth permanent magnet). The structure of the example magnet assembly 40 provides a permanent arc motion magnetic field 42 (FIG. 5). Since there is a single permanent magnet 74, there is sufficient space for a relatively larger ceramic magnet (e.g., larger than a relatively high energy rare earth permanent magnet). Alternatively, the permanent magnet 74 can be a rare earth permanent magnet, such as for example and without limitation, a single Neodymium magnet (e.g., without limitation, a permanent magnet made from an alloy of neodymium, iron, and boron to form a $Nd_2Fe_{14}B$ tetragonal crystalline structure), or a SmCo permanent magnet. Such rare earth magnets have a relatively stronger magnetic field, thereby permitting a relatively smaller permanent magnet thickness and allowing the arc chute width of the arc chambers 18,20 to be increased. Alternatively, a ceramic permanent magnet has a relatively weaker magnetic field, thereby needing a relatively larger thickness of permanent magnet and providing a relatively smaller width of the arc chutes in the arc chambers 18,20, as shown. It will be appreciated that greater (smaller) interruption current can be provided by a relatively larger (smaller) width of the arc chambers 18,20. Also, both of the ceramic and rare earth permanent magnets can be produced as either sintered or bonded. The bonded permanent magnets typically have a relatively much lower magnetic energy and contain up to 10% polymer by weight.

The example ferromagnetic frame 76 is partially surrounded by the example molded case 84. As shown in FIG. 5, the permanent magnet 74 has a first magnetic polarity (N) disposed toward the first arc chamber 18 and an opposite second magnetic polarity (S) disposed toward the second arc chamber 20.

In the example embodiment, the last arc plate 36B is optionally electrically connected to the load terminal 72 by a conductor 86 and arc plate 28B is optionally electrically connected to load terminal 71 by jumper 69 in order to cause the ejected arc to be eliminated when the arc that enters the arc chute connects to either arc plate 28B or 36B (depending on the direction of the current being interrupted). It will be appreciated that this "tied" arrangement is optional and need not be employed. Elimination of the ejected arc will reduce the generation of arc damage and debris in the "unused arc chamber" and general mechanism areas.

Back-striking can result when an arc moves and lengthens across and into the arc plates 28 or 36, thereby increasing the arc voltage. However, if the arc moves too quickly, then it can breakdown to a previous shorter length as caused by the higher arc voltage and the remaining conductivity of the old arc path. The disclosed arc runners 4,6, the splitter arc plates 28,36, and the magnetic field magnitude from the permanent magnet 74 and the ferromagnetic frame 76 provide for effective arc splitting and minimal back-striking.

Figure 6:
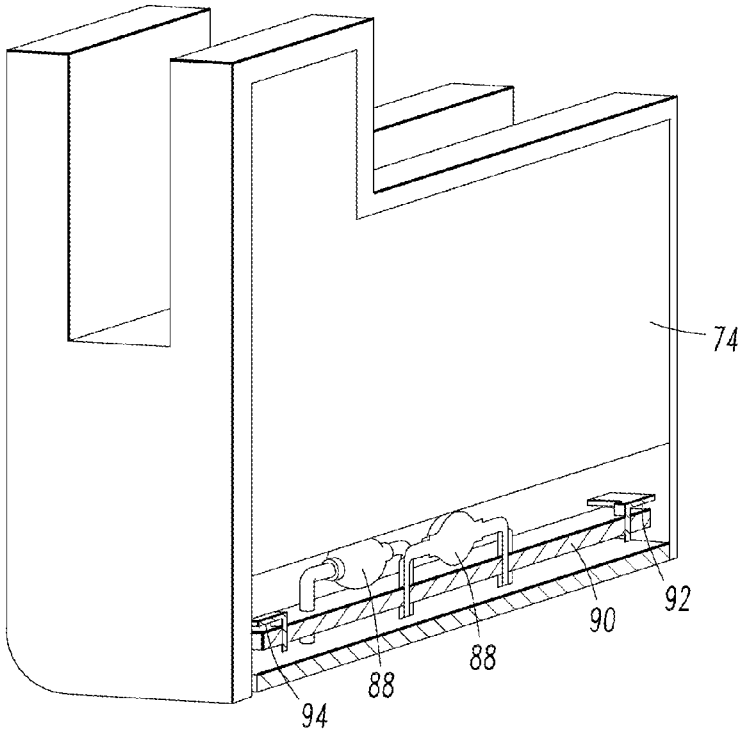
FIG. 6 is a cross-sectional view of an arc chamber and magnet assembly including two arc chambers, and a MOV printed circuit board in accordance with an embodiment of the disclosed concept.
Figure 7:
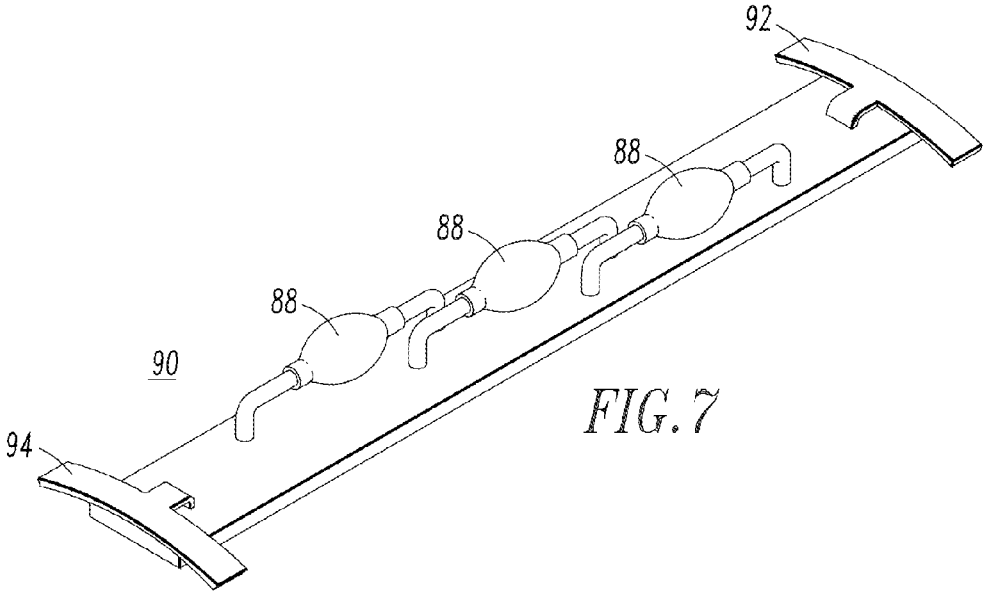
FIG. 7 is an isometric view of the MOV printed circuit board of FIG. 6.

Optionally, as shown in FIGS. 6 and 7, a number of MOVs 88 limit the series voltage of the arc plates 28,36 during interruption. MOV printed circuit (PC) board 90 is installed beneath the magnet 74. Two bridge contacts 92,94 each wedge into, for example and without limitation, the second arc plate 28C,28D;36C;36D (FIG. 3) from a corresponding end 22,30;24,32 (FIG. 3) of the two arc chambers 18,20. Only one side of the two arc chambers 18,20 carries the series voltage during an interruption based upon the polarity of the DC current. In this example, three MOVs 88 of the PC board 90 are employed (in series) to increase the effective MOV limiting voltage, while employing relatively small MOVs in a relatively small space, although it will be appreciated that any suitable number of MOVs can be employed. The MOVs 88 are structured to limit a first voltage across a plurality of the first arc plates 28 and a second voltage across a plurality of the second arc plates 36. In the example embodiment, the number of MOVs 88 are a plurality (e.g., three; any suitable number) of MOVs 88 electrically connected in series between a first terminal defined by the first bridge contact 92 and a second terminal defined by the second bridge contact 94. The first bridge contact 92 is electrically connected to one 28C of the first arc plates 28 proximate the first end 22 of the first arc chamber 18 and to one 36C of the second arc plates 36 proximate the first end 30 of the second arc chamber 20. The second bridge contact 94 is electrically connected to one 28D of the first arc plates 28 proximate the opposite second end 24 of the first arc chamber 18 and to one 36D of the second arc plates 36 proximate the opposite second end 32 of the second arc chamber 20. It will be appreciated that other suitable voltage limiting devices, such as, for example and without limitation, zener diodes and transorbs, can be employed to perform the function described of the example MOVs.

Preferably, a number of the first arc plates 28,28B,28D and a number of the second arc plates 36,36B,36D have a V-form, which V-form is known from alternating current circuit breakers. By this V-form, the arc will be forced to move to the root of the V. For example and without limitation, a dihedral form is employed that generates a dihedral effect in order to center the arc when moving into the arc plates 28,28B,28D or 36,36B,36D.

Preferably, suitable insulators (not shown) are disposed between the arc plate 28B or 28D and the ends 24 or 32 of the arc chambers 18 or 20, respectively. This avoids flashovers to these arc plates 28B or 28D when cooling the arc, increases the air clearance for the arc, dampens vibrations of the line terminal 71, and provides an adequate dead stop.

The disclosed concept provides negligible arc flash (e.g., negligible display of relatively high temperature arc gas products).

Many DC switching devices have a specified minimum interrupt current because the magnetic field per ampere requirement increases as the current decreases in order to assure suitable arc motion. These devices are not able to interrupt currents below this value. The disclosed concept provides switching performance over the current range from zero to a specified maximum rated interrupt current (e.g., without limitation, up to 1000 amperes) since sufficient magnetic field is present to move a relatively low current arc 46 or 50.

In the example embodiment, the open contact position is structured to interrupt current flow at a voltage of up to about 750 VDC. For example, 600 VDC to 1500 VDC solar string and combiner box applications employ a miniature relay or circuit breaker to replace fuses and provide a tripable and resetable device that incorporates solar arc fault algorithms. A single disclosed circuit breaker 2 can address 600 VDC to 750 VDC applications. Two of the disclosed circuit breakers 2 in series can address 1000 VDC to 1500 VDC applications.

The disclosed concept achieves 750 VDC bidirectional switching with only one permanent magnet 74. The example permanent magnet 74 and ferromagnetic frame 76 provide a suitable generally unidirectional magnetic field 42 to move example zero to 1000 ampere arcs to the splitter arc plates 28,36 of one of two arc chambers 18,20 where the resulting arc voltage is sufficient to interrupt 750 VDC.

Although a single permanent magnet 74 is shown, it will be appreciated that two magnets can be employed to provide the generally unidirectional magnetic field 42. For example, the single permanent magnet 74 in the center of the magnet assembly 40 can be replaced by two (e.g., without limitation, half-thickness) magnets (not shown) on the two opposing sides of the magnet assembly 40, where both magnets have the same polarity direction in order to establish the generally unidirectional magnetic field 42. Another non-limiting alternative is to add a ferromagnetic steel plate (not shown) in the center of the magnet assembly 40 instead of the single magnet 74 in the center.

The disclosed arc chambers 18,20 achieve a relatively higher voltage (e.g., up to 750 VDC) switching in a miniature DC switching device at a reduced cost.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. An electrical switching apparatus comprising:

a first arc runner;

a second arc runner;

a first contact in electrical communication with said first arc runner;

a second contact in electrical communication with said second arc runner;

a movable contact comprising a first portion and a second portion respectively cooperating with said first contact and said second contact to provide a closed contact position in which said movable contact electrically engages said first and second contacts, and an open contact position in which said movable contact is disengaged from said first and second contacts;

a first arc chamber comprising a first end, an opposite second end, a longitudinal axis therebetween, and a plurality of first arc plates between the first end and the opposite second end, one of the first arc plates at the first end of the first arc chamber being proximate said first arc runner, another one of the first arc plates at the opposite second end of the first arc chamber being proximate the first portion of said movable contact as said movable contact moves from the closed contact position toward the open contact position;

a second arc chamber comprising a first end, an opposite second end, a longitudinal axis therebetween, and a plurality of second arc plates between the first end and the opposite second end of the second arc chamber, one of the second arc plates at the first end of the second arc chamber being proximate said second arc runner, another one of the second arc plates at the opposite second end of the second arc chamber being proximate the second portion of said movable contact as said movable contact moves from the closed contact position toward the open contact position;

an operating mechanism cooperating with said movable contact to move said movable contact between the closed contact position and the open contact position; and a magnet assembly cooperating with said first and second arc chambers to establish a generally unidirectional magnetic field normal to the longitudinal axes of said first and second arc chambers, normal to a first direction of a first arc between the first contact and the first portion of the movable contact as said movable contact moves away from the closed contact position toward the open contact position, and normal to an opposite second direction of a second arc between the second contact and the second portion of the movable contact as said movable contact moves away from the closed contact position toward the open contact position, in order that said generally unidirectional magnetic field causes one of the first arc and the second arc to enter one of said first and second arc chambers, respectively, depending upon a direction of current flow between the first contact and the second contact.

2. The electrical switching apparatus of claim 1 wherein each of said first and second arc runners has a first portion on which one of said first and second contacts, respectively, is disposed, a second portion normal to the last said first portion and extending along the longitudinal axis of one of said first and second arc chambers, respectively, and a third portion normal to the last said second portion and extending parallel to one of the first and second arc plates at the first end of said first and second arc chambers, respectively.

3. The electrical switching apparatus of claim 1 wherein said magnet assembly comprises a single permanent magnet.

4. The electrical switching apparatus of claim 1 wherein said another one of the second arc plates at the opposite second end of the second arc chamber is electrically connected to a load terminal in order to eliminate an ejected arc during interruption of the current flow.

5. The electrical switching apparatus of claim 1 wherein said current flow between the first contact and the second contact is a direct current.

6. The electrical switching apparatus of claim 1 wherein the first direction of the first arc between the first contact and the first portion of the movable contact as said movable contact moves away from the closed contact position toward the open contact position is generally along the longitudinal axis of said first arc chamber and toward the first end of the first arc chamber; wherein said generally unidirectional magnetic field causes the first arc to enter the first arc chamber; wherein the opposite second direction of the second arc between the second contact and the second portion of the movable contact as said movable contact moves away from the closed contact position toward the open contact position is generally along the longitudinal axis of said second arc chamber and away from the first end of the second arc chamber; and wherein said generally unidirectional magnetic field causes the second arc to avoid the second arc chamber.

7. The electrical switching apparatus of claim 1 wherein said magnet assembly comprises a single ceramic magnet.

8. The electrical switching apparatus of claim 1 wherein a magnitude of said current flow for interruption by said first, second and movable contacts is from zero amperes to a predetermined maximum amperes.

9. The electrical switching apparatus of claim 1 wherein said first arc plates at the opposite second end of the first arc chamber and said second arc plates at the opposite second end of the second arc chamber have a first end facing one of the first and second portions of the movable contact and an opposite second end; and wherein said generally unidirectional magnetic field is structured to cause said one of the first arc and the second arc to define a stable final arc position among said first arc plates and said second arc plates, respectively, and toward the opposite second end of said first and second arc plates.

10. The electrical switching apparatus of claim 1 wherein said direction of current flow between the first contact and the second contact is selected from the group consisting of alternating current, positive direct current, negative direct current, and bi-directional direct current.

11. The electrical switching apparatus of claim 1 wherein the open contact position is structured to interrupt the current flow at a voltage of up to about 750 VDC.

12. The electrical switching apparatus of claim 1 wherein said electrical switching apparatus is a circuit interrupter; and wherein said operating mechanism comprises a trip mechanism.

13. The electrical switching apparatus of claim 12 wherein said trip mechanism comprises at least one of a bimetal and a magnetic trip coil.

14. The electrical switching apparatus of claim 12 wherein said trip mechanism comprises a bimetal electrically connected to a load terminal.

15. The electrical switching apparatus of claim 13 wherein said magnetic trip coil is electrically connected between a load terminal and said first contact.

16. The electrical switching apparatus of claim 1 wherein said magnet assembly comprises a permanent magnet, a ferromagnetic frame and an insulative case including a first portion holding said first arc chamber, a second portion holding said second arc chamber, and a third portion holding said permanent magnet between the first and second arc chambers.

17. The electrical switching apparatus of claim 16 wherein the insulative case partially surrounds the first and second arc chambers.

18. The electrical switching apparatus of claim 1 wherein said magnet assembly comprises a magnet having a first magnetic polarity disposed toward said first arc chamber and an opposite second magnetic polarity disposed toward said second arc chamber.

19. The electrical switching apparatus of claim 1 wherein said magnet assembly comprises a magnet selected from the group consisting of a single Neodymium permanent magnet, a single SmCo permanent magnet, and a single ceramic magnet.

20. The electrical switching apparatus of claim 1 wherein said magnet assembly comprises a number of MOVs structured to limit a first voltage across a plurality of the first arc plates and a second voltage across a plurality of the second arc plates.

21. The electrical switching apparatus of claim 20 wherein said number of MOVs are a plurality of MOVs electrically connected in series between a first terminal and a second terminal; wherein the first terminal is electrically connected to one of the first arc plates proximate the first end of the first arc chamber and to one of the second arc plates proximate the first end of the second arc chamber; and wherein the second terminal is electrically connected to one of the first arc plates proximate the opposite second end of the first arc chamber and to one of the second arc plates proximate the opposite second end of the second arc chamber.

* * * * *